US007188631B2

(12) United States Patent
Fleissner

(10) Patent No.: US 7,188,631 B2
(45) Date of Patent: Mar. 13, 2007

(54) SUCTION DEVICE ON A TEXTILE MACHINE, ESPECIALLY A WATER NEEDLING DEVICE

(75) Inventor: Gerold Fleissner, Zug (CH)

(73) Assignee: Fleissner GmbH & Co. Maschinenfabrik, Egelsbach (DE)

( * ) Notice: Subject to any disclaimer, the term of this patent is extended or adjusted under 35 U.S.C. 154(b) by 211 days.

(21) Appl. No.: 10/250,968

(22) PCT Filed: Jan. 9, 2002

(86) PCT No.: PCT/EP02/00121

§ 371 (c)(1),
(2), (4) Date: Dec. 29, 2003

(87) PCT Pub. No.: WO02/055776

PCT Pub. Date: Jul. 18, 2002

(65) Prior Publication Data

US 2004/0123436 A1 Jul. 1, 2004

(30) Foreign Application Priority Data

Jan. 11, 2001 (DE) ..... 101 01 207

(51) Int. Cl.
*B08B 3/02* (2006.01)

(52) U.S. Cl. ..... 134/166 R; 134/167 R

(58) Field of Classification Search ..... 15/309.1, 15/134, 166 R, 167 R
See application file for complete search history.

(56) References Cited

U.S. PATENT DOCUMENTS 1,791,384 A * 2/1931 Sheafor ..... 162/278
2,300,909 A * 11/1942 Broughton ..... 239/752
2,409,424 A * 10/1946 Falk ..... 70/38 A
2,672,238 A * 3/1954 Walters ..... 210/297
2,772,606 A * 12/1956 Kelly ..... 162/276
2,995,186 A * 8/1961 De Montigny ..... 162/295
3,088,859 A * 5/1963 Smith ..... 264/518
3,098,788 A * 7/1963 Hornbostel, Jr. ..... 162/274
3,617,441 A * 11/1971 Farrell ..... 162/199
4,240,871 A * 12/1980 Burkhart ..... 162/274

(Continued)

FOREIGN PATENT DOCUMENTS

DE 32 33 963 * 3/1984

(Continued)

OTHER PUBLICATIONS

WIPO WO 85/0153 Apr. 1985.*

*Primary Examiner*—Frankie L. Stinson
(74) *Attorney, Agent, or Firm*—Antonelli, Terry, Stout and Kraus, LLP.

(57) ABSTRACT

The inner circumferential surface of a suction pipe must be periodically cleaned as well as the inner region of the suction slit and especially the webs between the suction holes of the suction pipe. The aim of the invention is to facilitate said cleaning process. To this end, a standard cleaning spray gun is provided with a long cleaning lance comprising a rotor nozzle on the end thereof. In order to clean the suction pipe, said lance can be passed through a hole on the front side of the fixed suction pipe. The dirt released and the remaining suction water can thus be evacuated on the other front side in a problem-free manner.

4 Claims, 1 Drawing Sheet

U.S. PATENT DOCUMENTS

| | | | | | |
|---|---|---|---|---|---|
| 5,152,891 | A | * | 10/1992 | Netkowicz et al. | 210/408 |
| 6,135,025 | A | * | 10/2000 | Zimmer | 101/129 |
| 6,174,414 | B1 | * | 1/2001 | Theriault | 162/278 |

FOREIGN PATENT DOCUMENTS

| | | | |
|---|---|---|---|
| DE | 19925703 | | 12/2000 |
| EP | 0088859 | | 9/1983 |
| EP | 0853156 | | 7/1998 |
| EP | 1059377 | | 12/2000 |
| JP | 3-8883 | * | 1/1991 |
| JP | 6-166983 | * | 6/1994 |
| JP | 6-257090 | * | 9/1994 |
| JP | 11-155557 | * | 6/1999 |

* cited by examiner

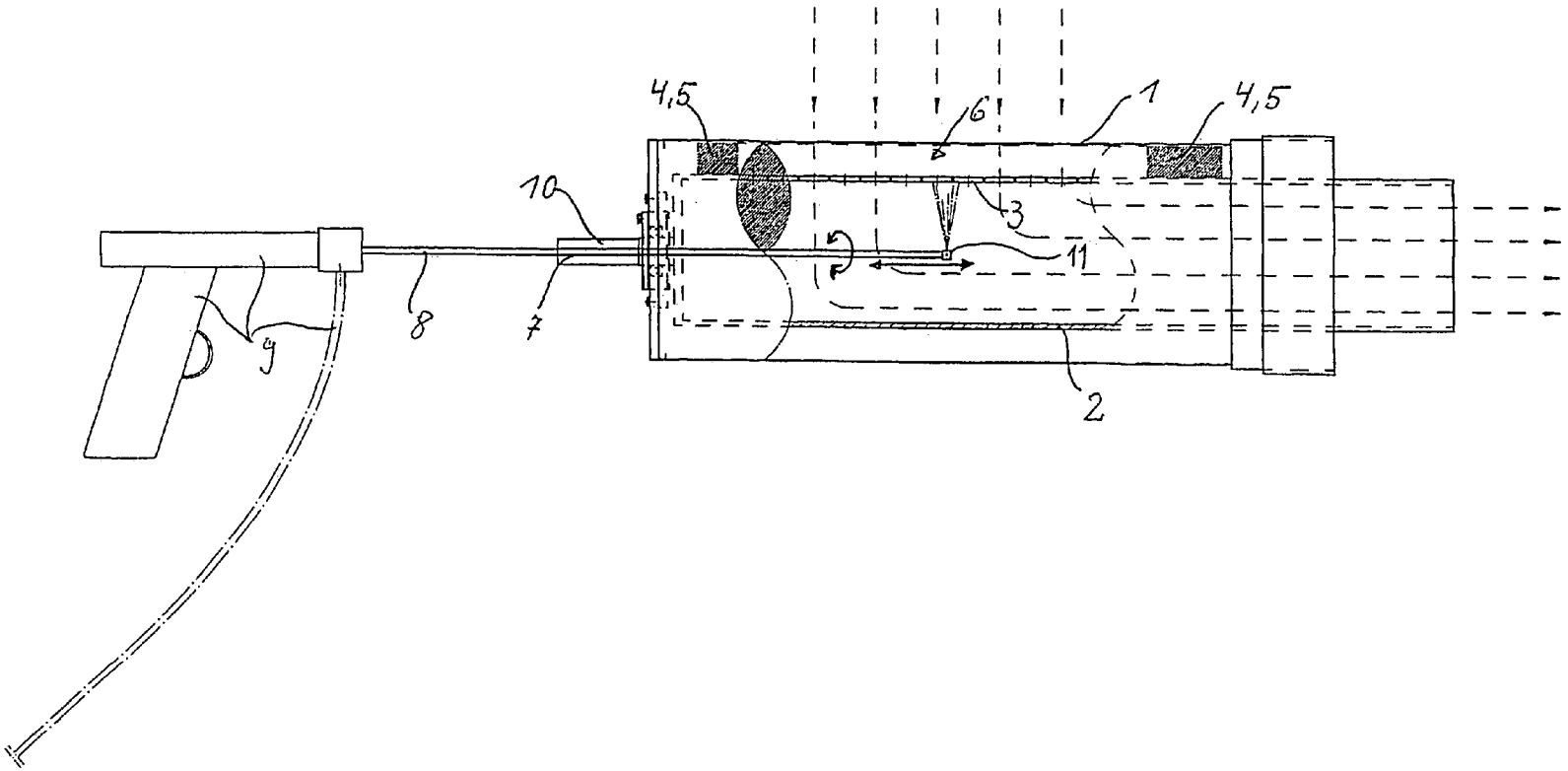
4,5
1
6
3
11
2
4,5
10
7
8
9

SUCTION DEVICE ON A TEXTILE MACHINE, ESPECIALLY A WATER NEEDLING DEVICE

BACKGROUND OF THE INVENTION

The invention relates to a suction device for fluids, especially on water needling machines, to which device a water manifold for generating fluid jets is attached, possibly consisting of a suction tube with suction holes arranged over the working length of the tube, through which holes the fluid is extracted by a partial vacuum generated in the tube, and wherein slide strips are arranged on both sides and parallel to the holes to support a transport means, such as a perforated drum, for the web-like material to be needled. Because of the partial vacuum to be generated between 20 mbar and 400 mbar, the fixed suction tube must be of an extremely robust design. The suction tubes are therefore drilled into a rigid tube. The slide strips for the drum transporting the material are then fixed laterally relative to these openings, which strips define the suction slit.

A suction device of this type is described in European Patent EP-A-1 059 377. Not only water but also a large quantity of fiber or pulp, depending on the material to be dewatered, is forced by the suction tube through the suction slit or suction openings of the suction tube. An unavoidable phenomenon is that not only the suction strips or webs between the suction openings but also the interior surface of the suction tube become contaminated and must be cleaned to ensure a uniform dewatering effect. Previously, in order to accomplish this, the front end of the tube had to be disassembled and exposed so as to make the interior surface of the tube accessible for cleaning.

This condition is also not remedied by the cleaning device, known from European Patents 0 853 156 or 0 088 859, which is provided for the cleaning of the perforated drum. In this design, a cleaning tube extends through the front side, through the shaft of the drum carrying the material, from the openings of which tube water is sprayed against the drum, the openings being directed at the interior surface of the drum.

SUMMARY OF THE INVENTION

The goal of the invention is to enable simple cleaning even of the interior tube—as much as possible during the unmodified assembled state of the suction device.

Starting with the suction device of the type referred to at the outset, this goal is achieved by providing the circumferential interior surface of the suction tube with a cleaning device. Preferably, this is feasible if the cleaning device treats the interior side of the suction tube with a cleaning fluid such as water as a result of a cleaning strip being mounted with a water-conducting interior tube and a spray nozzle, such as a rotary nozzle, in the suction tube in a movably insertable fashion. To this end, it is expedient to introduce this cleaning strip through a hole at the end face of the suction device which is then advantageously provided in the stationary mounting shaft of the suction tube.

BRIEF DESCRIPTION OF THE DRAWING

An example of a device of the type according to the invention is shown in the drawing. The FIGURE is a side view of part of a suction device with an insertable cleaning gun at the end face.

DETAILED DESCRIPTION OF THE INVENTION

The suction device according to German Patent A-199 25 703 comprises a fluid-permeable, rotatably mounted drum 1 on which the material for needling and/or dewatering rests. A water manifold, not shown here, may be situated above and attached to drum 1, from which manifold water jets emerge under high pressure and impact the material. The sprayed water must be extracted immediately thereafter below the material. To this end, a suction tube 2 is mounted centrically in stationary fashion within drum 1, into the wall of which tube are incorporated suction holes or slits 3 along a surface line. Slide strips 4, 5 determining the width of the suction slit 6 are affixed to the right and left of these openings 3 and parallel to the surface line radially outside tube 2. These slide strips 4, 5 support drum 1 which is mounted, along with the material, rotatably around suction tube 2.

At one end, suction tube 2 is mounted centrically through mounting shaft 10, while at the other end the similarly mounted suction tube 2 terminates in a water and lint separation device, the details of which are not shown here.

The requirement is to be able to easily clean the circumferential interior surface of suction tube 2. To this end, a hole 7 is provided in the end of stationary tube 2, through which hole the cleaning strip 8 of a hand-operated water-jet cleaning device may be inserted. Hole 7 is incorporated into the center of mounting shaft 10 of suction tube 2, with the result that the tubular strip 8 of cleaning gun 9, including a water jet nozzle 11 at its inserted free end, may be easily inserted into the interior of suction tube 2 without significant disassembly of the suction device.

Nozzle 11 should be a rotary nozzle which, depending on the inclination, is able to treat both the entire interior circumferential surface of the suction tube and an especially contaminated region in linear fashion by moving lance 8 back and forth.

The invention claimed is:

1. Suction device for fluids, especially on water needling machines, to which device a water manifold for generating fluid jets is attached, comprising a non-rotatably-mounted suction tube with suction holes arranged over the working length of the tube, through which holes the fluid is extracted by a partial vacuum generated in the tube, and wherein slide strips are arranged on both sides and parallel to the holes, and radially outside the tube, to support a transport means, such as a perforated drum, for the web-like material to be needled, characterized in that the inner circumferential surface of the suction tube is provided with a cleaning device which is insertable through a hole incorporated in a shaft at a front end of the suction tube, is movable within the suction tube and uses a cleaning fluid such as water to treat the interior side, at least of the suction openings of the suction tube.

2. Suction device according to claim 1, characterized in that a cleaning strip, along with a water-conducting interior tube and a spray nozzle at its end, is mounted so as to be movably insertable into the suction tube.

3. Suction device according to claim 2, characterized in that the spray nozzle is designed as a rotary nozzle.

4. Suction device according to claim 1 characterized in that the hole is incorporated into a non-rotating section of the shaft at the front end of the suction tube.

* * * * *